US009169091B2

(12) United States Patent
Tahara et al.

(10) Patent No.: US 9,169,091 B2
(45) Date of Patent: Oct. 27, 2015

(54) SHEET FEEDER AND IMAGE FORMING APPARATUS PROVIDED WITH SAME

(71) Applicant: KYOCERA Document Solutions Inc., Osaka-shi, Osaka (JP)

(72) Inventors: Mitsuhiro Tahara, Osaka (JP); Hiroki Ozawa, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/288,907

(22) Filed: May 28, 2014

(65) Prior Publication Data

US 2014/0353904 A1 Dec. 4, 2014

(30) Foreign Application Priority Data

May 29, 2013 (JP) ..... 2013-112645

(51) Int. Cl.

| | |
|---|---|
| ***B65H 3/52*** | (2006.01) |
| ***B65H 3/06*** | (2006.01) |
| ***B65H 3/32*** | (2006.01) |
| ***B65H 5/06*** | (2006.01) |

(52) U.S. Cl.
CPC .. *B65H 3/06* (2013.01); *B65H 3/32* (2013.01); *B65H 5/06* (2013.01)

(58) Field of Classification Search
CPC .... B65H 3/0638; B65H 27/00; B65H 3/5223; B65H 3/56; B65H 3/5261; B65H 3/5246; B65H 3/063; B65H 3/5238; B65H 1/04; B65H 1/266
USPC ..... 271/109, 121–124, 145
See application file for complete search history.

(56) References Cited

U.S. PATENT DOCUMENTS

2011/0127710 A1* 6/2011 Yamomoto et al. ..... 271/10.11
2013/0277907 A1* 10/2013 Yamomoto et al. ..... 271/109

FOREIGN PATENT DOCUMENTS

| | | | |
|---|---|---|---|
| JP | 2001-39587 | | 2/2001 |
| JP | 2004-35203 | * | 2/2004 |
| JP | 2006-176320 | | 7/2006 |

* cited by examiner

*Primary Examiner* — Thomas Morrison
(74) *Attorney, Agent, or Firm* — Gerald E. Hespos; Michael J. Porco; Matthew T. Hespos

(57) ABSTRACT

A sheet feeder includes a casing, a sheet stacking portion, a sheet conveyance path, a feed roller, a separation pad, a holder, a mounting portion and a guiding member. The sheets are placed on the sheet stacking portion and fed in a predetermined direction in the sheet conveyance path. A nip portion, through which the sheet passes, is formed between the feed roller and the separation pad. The holder fixedly supports the separation pad and is mountable into and removable from the mounting portion of the casing. The guiding member guides the holder. The posture of the holder is changeable between a first posture in which a predetermined clearance is formable between the guiding member and the holder when the holder is mounted into the mounting portion and a second posture in which the holder is pressed against the guiding member when the sheet passes through the nip portion.

15 Claims, 11 Drawing Sheets

SHEET FEEDER AND IMAGE FORMING APPARATUS PROVIDED WITH SAME

This application is based on Japanese Patent Application Serial No. 2013-112645 filed with the Japan Patent Office on May 29, 2013, the contents of which are hereby incorporated by reference.

BACKGROUND

The present disclosure relates to a sheet feeder for feeding a sheet and an image forming apparatus provided with the same.

Conventionally, a sheet feeder mounted in an image forming apparatus is known as a sheet feeder for feeding a sheet. The sheet feeder feeds sheets stored in a sheet tray one by one in a sheet feeding direction. The sheet is fed to a downstream side in the sheet feeding direction through a separation nip portion formed between a feed roller and a separation pad. The separation pad is biased toward the feed roller by a spring member.

SUMMARY

A sheet feeder according to one aspect of the present disclosure includes a casing, a sheet stacking portion, a sheet conveyance path, a feed roller, a separation pad, a holder, a mounting portion and a guiding member. The sheet stacking portion is arranged in the casing and sheets are to be placed thereon. The sheet conveyance path is arranged in the casing and the sheets stacked on the sheet stacking portion are fed in a predetermined sheet feeding direction therein. The feed roller is mounted in the casing to face a downstream side of the sheet stacking portion in the sheet feeding direction from above and feeds the sheet toward the sheet conveyance path. The separation pad is arranged to face the feed roller, forms a nip portion, through which the sheet passes, between the feed roller and the separation pad and feeds the sheets one by one in the sheet feeding direction. The holder fixedly supports the separation pad and is mountable into and removable from the casing. The mounting portion is arranged in the casing and the holder is mounted into the mounting portion. The guiding member is arranged in the mounting portion and guides the holder. The posture of the holder is changeable between a first posture in which a predetermined clearance is formable between the guiding member and the holder when the holder is mounted into the mounting portion and a second posture in which the holder is pressed against the guiding member when the sheet passes through the nip portion after the holder is mounted into the mounting portion.

An image forming apparatus according to another aspect of the present disclosure includes the above sheet feeder and an image forming unit. The image forming unit is arranged in the casing and forms an image on a sheet.

These and other objects, features and advantages of the present disclosure will become more apparent upon reading the following detailed description along with the accompanying drawings.

DETAILED DESCRIPTION

Figure 1:
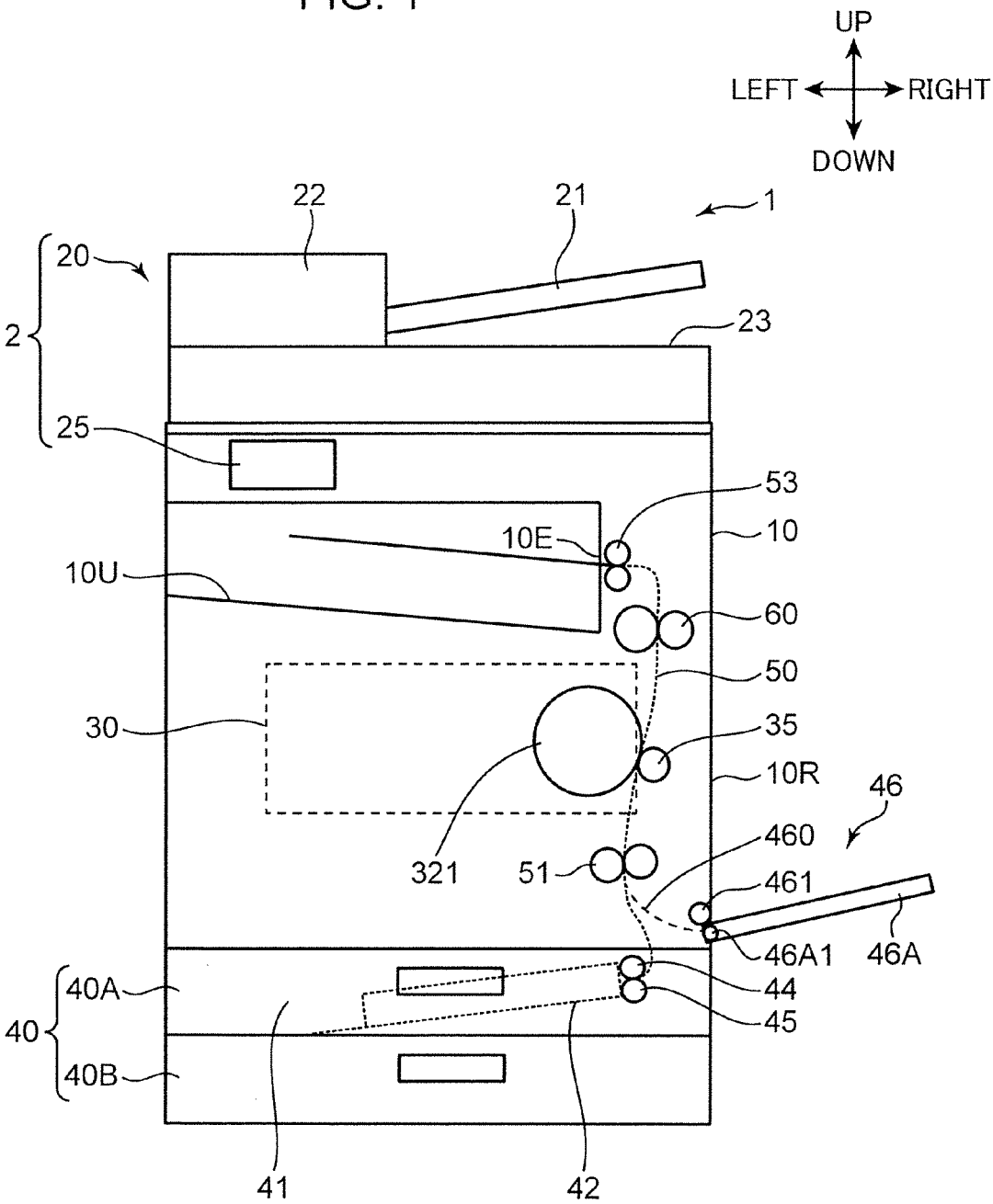
FIG. 1 is a diagrammatic sectional view showing the structure of an image forming apparatus according to an embodiment of the present disclosure.

Hereinafter, an embodiment of the present disclosure is described based on the drawings. FIG. 1 is a diagrammatic sectional view showing the internal structure of an image forming apparatus 1 according to one embodiment of the present disclosure. Although a complex machine provided with a printer function and a copier function is illustrated as the image forming apparatus 1 here, the image forming apparatus may be a printer, a copier, a facsimile machine or the like.

<Description of Image Forming Apparatus>

The image forming apparatus 1 includes an apparatus main body 10 (casing) having a substantially rectangular parallelepipedic casing structure and an automatic document feeder 20 arranged atop the apparatus main body 10. A reading unit 25 (reading mechanism) configured to optically read an image of a document to be copied, an image forming unit 30 configured to form a toner image on a sheet, a fixing unit 60 configured to fix the toner image to the sheet, a sheet feeding unit 40 configured to store fixed form sheets to be conveyed to the image forming unit 30 and a conveyance path 50 configured to convey the fixed form sheet from the sheet feeding unit 40 or a manual sheet feeding unit 46 to a sheet discharge opening 10E by way of the image forming unit 30 and the fixing unit 60 are housed in the apparatus main body 10.

The automatic document feeder (ADF) 20 is rotatably mounted on the upper surface of the apparatus main body 10. The ADF 20 automatically feeds a document sheet to be copied toward a predetermined document reading position in the apparatus main body 10. On the other hand, if a user manually places a document sheet at a predetermined document reading position, the ADF 20 is opened upward. The ADF 20 includes a document tray 21 on which document sheets are to be placed, a document feeding unit 22 configured to feed the document sheet by way of the document reading position, and a document discharge tray 23 to which the document sheet after reading is discharged.

A contact glass used to read a document sheet automatically fed from the ADF 20 or a contact glass (not shown) used to read a manually placed document sheet is arranged on the upper surface of the apparatus main body 10. The reading unit 25 optically reads images of the document sheets through these contact glasses. Note that an image reading apparatus 2 to be described later is configured by the above automatic document feeder (ADF) 20 and reading unit 25.

The image forming unit 30 generates a toner image and forms the toner image on a sheet based on a known electrophotographic method. Note that another image forming method such as an ink jet method may be adopted in another embodiment. The image forming unit 30 includes a photoconductive drum 321, and unillustrated charger, exposure device, developing device, cleaning device and the like arranged around this photoconductive drum 321.

The photoconductive drum 321 rotates about its shaft and an electrostatic latent image and a toner image are formed on the circumferential surface thereof. The charger uniformly charges the surface of the photoconductive drum 321. The exposure device includes optical devices such as a laser light source, mirrors and lenses and irradiates light based on image data of a document image to the circumferential surface of the photoconductive drum 321 to form an electrostatic latent image. The developing device supplies toner to the circumferential surface of the photoconductive drum 321 to develop the electrostatic latent image formed on the photoconductive drum 321. The cleaning device includes a cleaning roller and the like and cleans the circumferential surface of the photoconductive drum 321 after the transfer of the toner image. A transfer roller 35 (transfer mechanism) is arranged to face the photoconductive drum 321. A toner image on the photoconductive drum 321 is transferred to a sheet in a transfer nip portion between the photoconductive drum 321 and the transfer roller 35. A secondary transfer bias having a polarity opposite to that of the toner image is applied to the transfer roller 35.

The sheet feeding unit 40 includes a first sheet cassette 40A and a second sheet cassette 40B arranged in two levels for storing fixed form sheets P. These sheet cassettes can be pulled out forward from a front side of the apparatus main body 10.

The first sheet cassette 40A includes a sheet storing portion 41 configured to store a sheet stack formed by stacking the fixed form sheets P and a lift plate 42 configured to lift up the sheet stack for sheet feeding. An unillustrated pickup roller and a roller pair composed of a feed roller 44 and a retard roller 45 are arranged in an upper part of a right side of the sheet cassette 40A. The uppermost sheet P of the sheet stack in the sheet cassette 40A is picked up one by one and carried into an upstream end of the conveyance path 50 by driving the pickup roller and the feed roller 44. Note that the second sheet cassette 40B is configured similarly to the first sheet cassette 40A.

The manual sheet feeding unit 46 (sheet feeder) is arranged on a right side surface 1 OR of the apparatus main body 10. The manual sheet feeding unit 46 feeds a sheet toward the image forming unit 30. The manual sheet feeding unit 46 includes a manual tray 46A (sheet stacking portion) for manual sheet feeding and a feed roller 461. A sheet is placed on the manual tray 46A. The manual tray 46A is mounted to be openable and closable relative to the apparatus main body 10 with a supporting point portion 46A1 arranged on a lower end part of the manual tray 46A as a supporting point. A user opens the manual tray 46A as shown and places a sheet thereon in the case of performing manual sheet feeding. The sheet placed on the manual tray 46A is carried into a manual sheet conveyance path 460 (sheet conveyance path), which extends from the manual tray 46A and in which the sheet is fed in a predetermined sheet feeding direction, in the apparatus main body 10 by driving the feed roller 461. The sheet fed in the sheet feeding direction is carried into the conveyance path 50 from the manual sheet conveyance path 460. The feed roller 461 is driven and rotated and feeds the sheet toward the manual sheet conveyance path 460. The feed roller 461 is mounted in the apparatus main body 10 to face a downstream side of the manual tray 46 in the sheet feeding direction from above.

The conveyance path 50 extends from the sheet feeding unit 40 to the sheet discharge opening 10E through the image forming unit 30 and the fixing unit 60. A pair of registration rollers 51 are arranged upstream of the transfer nip portion in the conveyance path 50. A sheet is temporarily stopped at the pair of registration rollers 51 in a stopped state for a skew correction. Thereafter, the sheet is fed to the transfer nip portion by driving and rotating the pair of registration rollers 51 by a driver (not shown) at a predetermined timing for image transfer. Besides, a plurality of unillustrated sheet conveyor rollers configured to convey a sheet are arranged in the conveyance path 50.

Discharge rollers 53 are arranged at a most downstream end of the conveyance path 50. The discharge rollers 53 discharge the sheet P from the sheet discharge opening 10E. The sheet P discharged from the sheet discharge opening 10E is discharged and placed on a discharging portion 10U.

The fixing unit 60 applies a fixing process of fixing a toner image to a sheet. A pressure roller is pressed into contact with an unillustrated fixing roller to form a fixing nip portion. The toner image transferred to the sheet is fixed to the sheet by the passage of the sheet through the fixing nip portion.

<Concerning Manual Sheet Feeding Unit>

Figure 2:
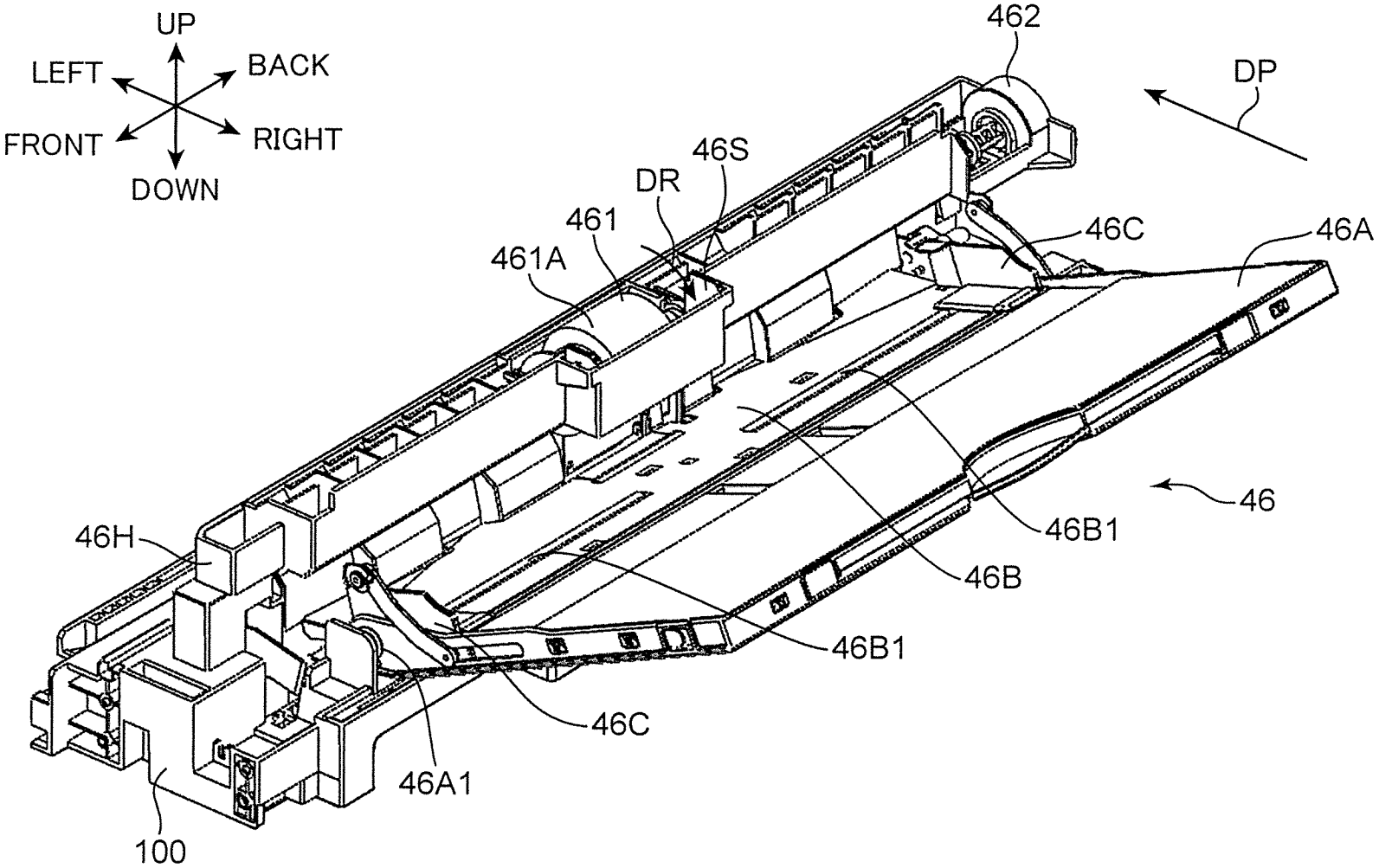
FIG. 2 is a perspective view of a manual sheet feeding unit according to the embodiment of the present disclosure.
Figure 3:
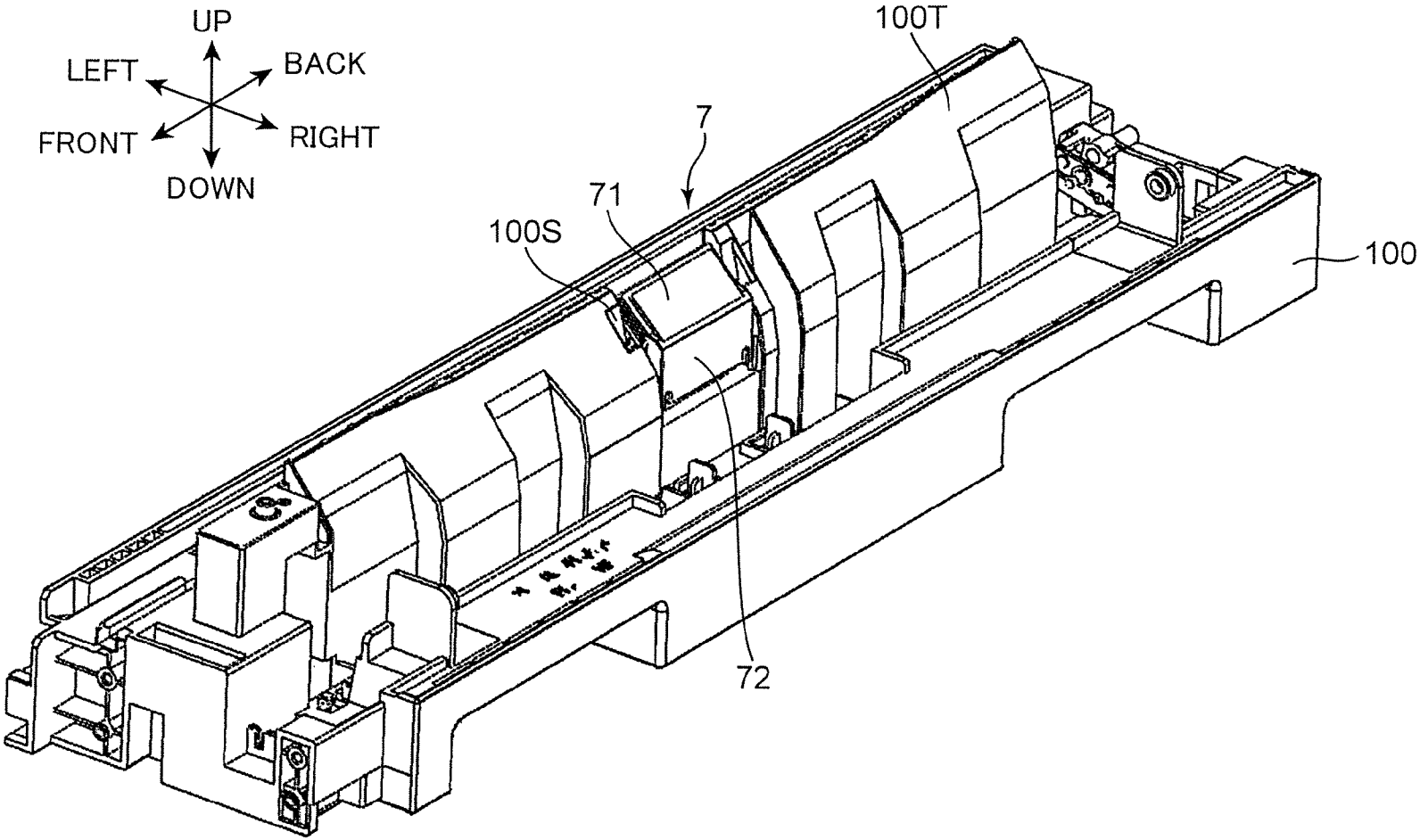
FIG. 3 is a perspective view of the interior of the manual sheet feeding unit according to the embodiment of the present disclosure.
Figure 4:
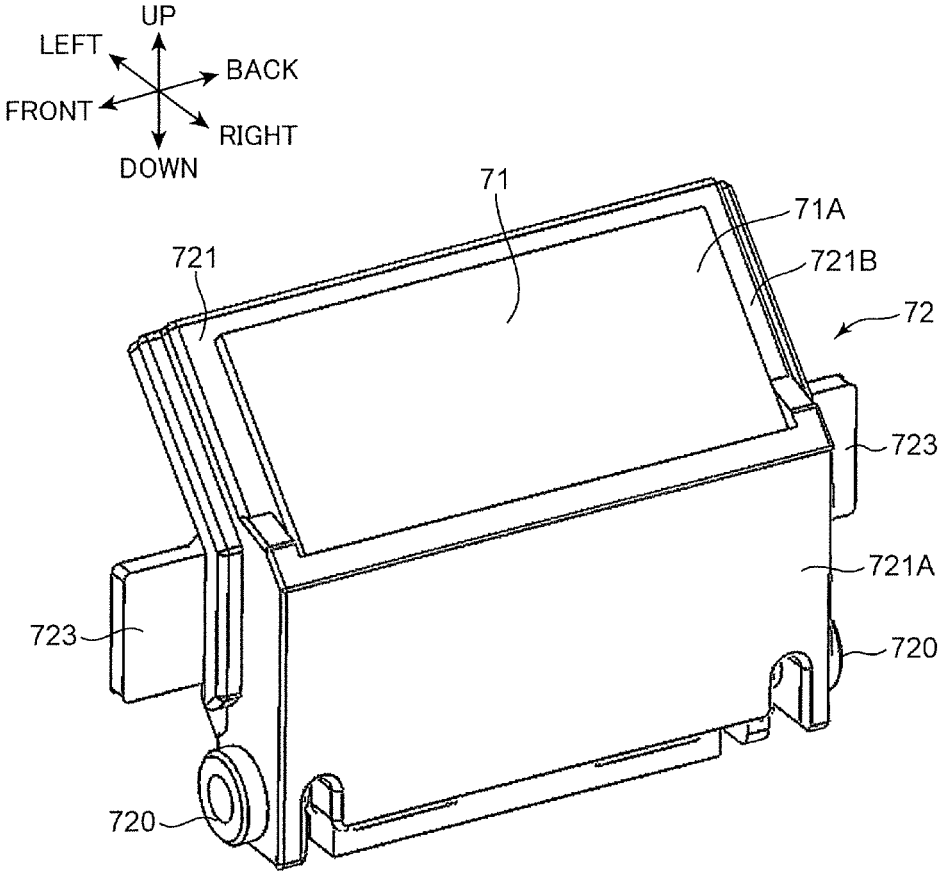
FIG. 4 is a perspective view of a part of a holder according to the embodiment of the present disclosure.
Figure 5:
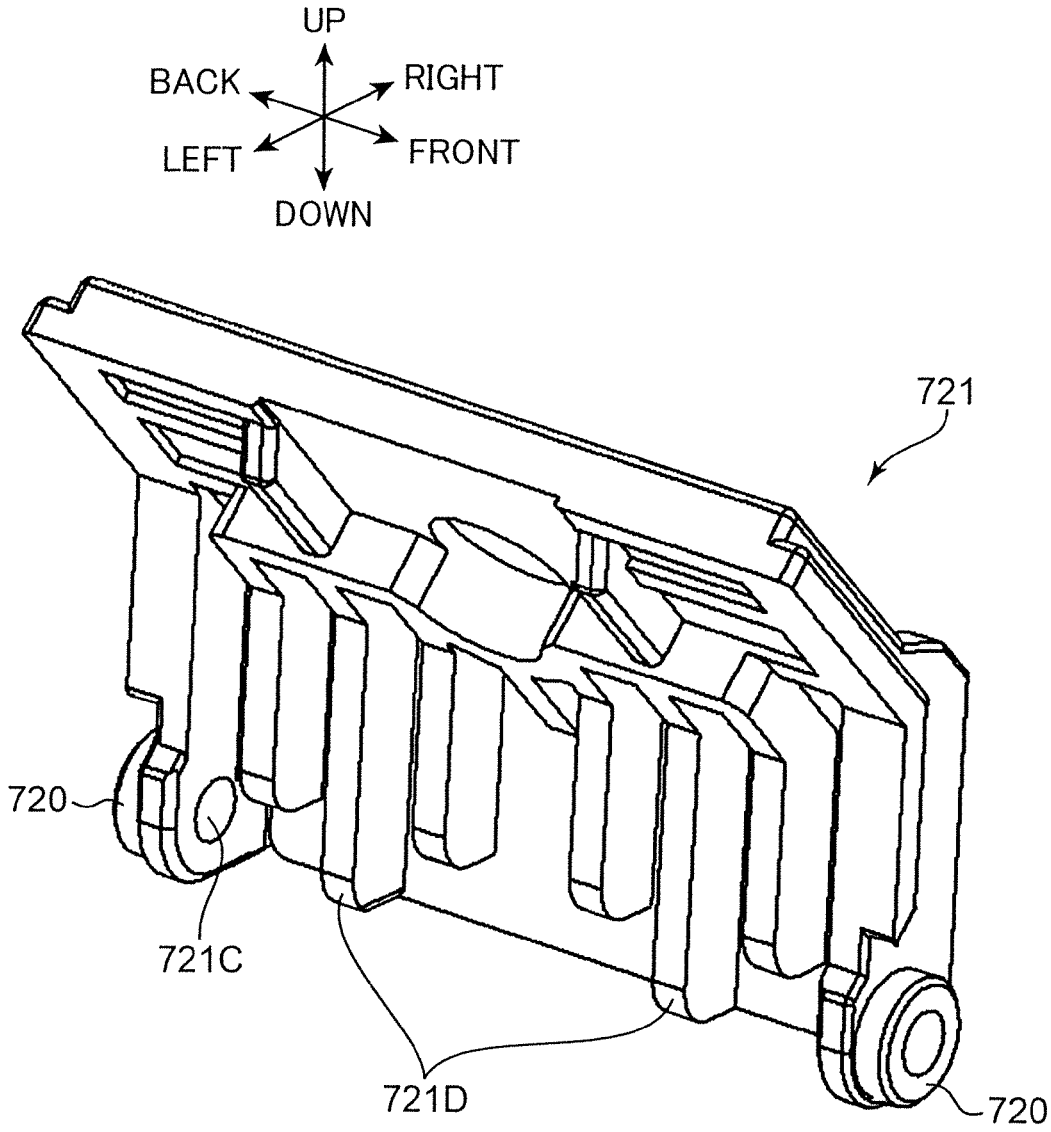
FIG. 5 is a perspective view of the part of the holder according to the embodiment of the present disclosure.
Figure 6:
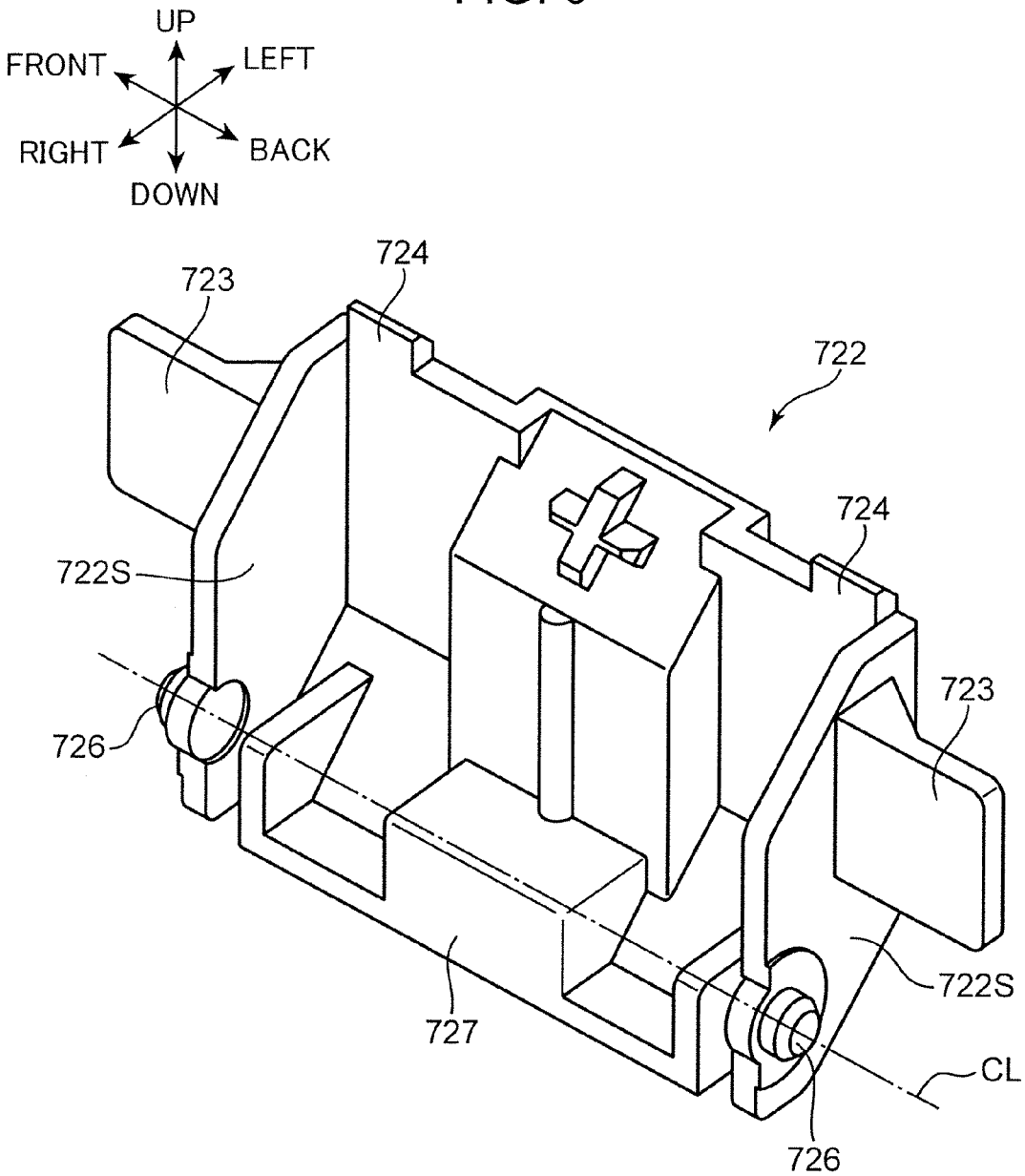
FIG. 6 is a perspective view of a part of the holder according to the embodiment of the present disclosure.
Figure 7:
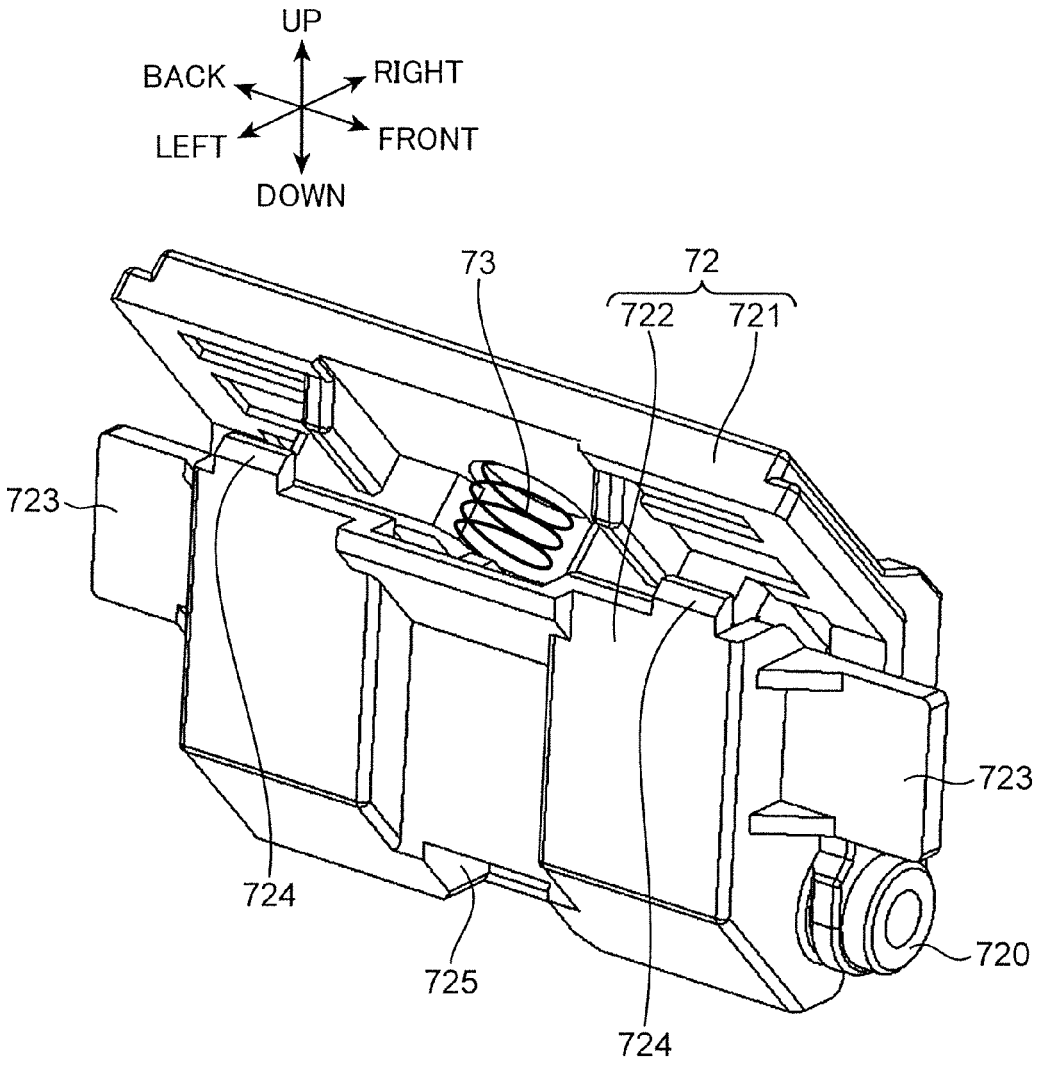
FIG. 7 is a perspective view of the holder according to the embodiment of the present disclosure.
Figure 8:
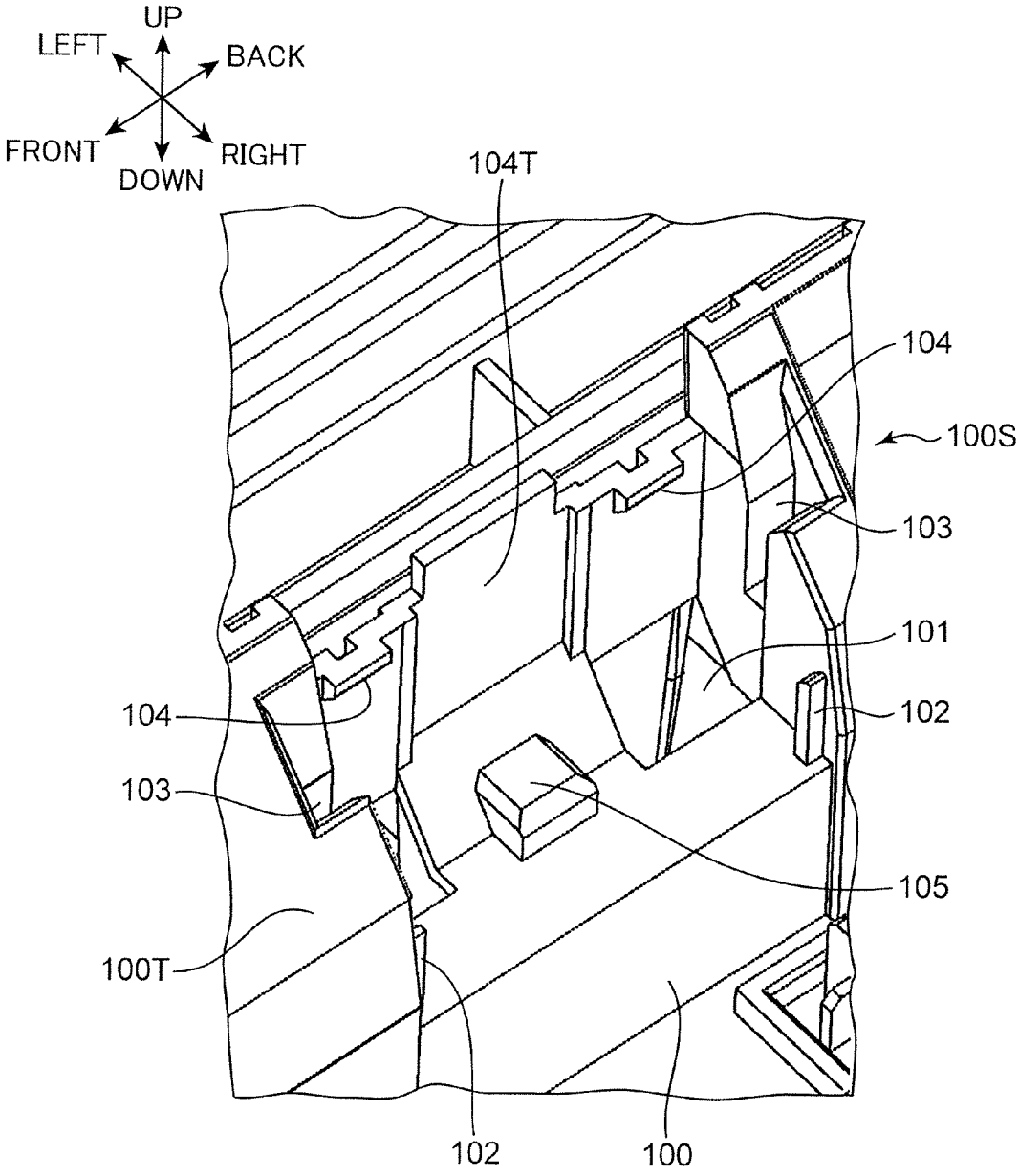
FIG. 8 is a perspective view of a mounting portion according to the embodiment of the present disclosure.

Next, the manual sheet feeding unit 46 according to this embodiment is described in detail with reference to FIGS. 2 to 8. FIG. 2 is a perspective view of the manual sheet feeding unit 46 according to this embodiment. FIG. 3 is a perspective view of the interior of the manual sheet feeding unit 46 in a state where a housing 46H is removed from the manual sheet feeding unit 46. FIG. 4 is a perspective view of a first holder portion 721 of a pad holder 72 when viewed from right. FIG. 5 is a perspective view of the first holder portion 721 when viewed from left. FIG. 6 is a perspective view of a second holder portion 722. FIG. 7 is a perspective view of the pad holder 72 when viewed from left. FIG. 8 is an enlarged perspective view of a mounting portion 100S in which the pad holder 72 is to be mounted.

With reference to FIG. 2, the manual sheet feeding unit 46 includes a main body unit 100, the aforementioned manual tray 46A, a manual lift plate 46B, width adjusting guides 46C, the feed roller 461 and the housing 46H (roller housing).

The main body unit 100 is arranged on the right side surface 10R (FIG. 1) of the apparatus main body 10. The main body unit 100 constitutes a part of the apparatus main body 10. As shown in FIG. 3, the main body unit 100 extends in a front-back direction while having a predetermined width in a lateral direction. A guiding surface 100T (FIG. 3) is arranged in a lateral central part of the main body unit 100. The guiding surface 100T is a wall surface defining a lower side of the manual sheet conveyance path 460 at a side downstream of the manual tray 46A in the sheet feeding direction. A sheet is guided toward a left-upper side by the guiding surface 100T.

The aforementioned manual tray 46A is a plate-like member which is openable and closable relative to the main body unit 100. The manual tray 46A is rotatable about the supporting point portion 46A1 (FIG. 2). The sheet is fed from the manual tray 46A in a direction of an arrow DP of FIG. 2 (sheet feeding direction, also referred to as feeding direction).

The manual lift plate 46B forms a part of an upper surface part of the manual tray 46A and is arranged to the left (downstream side in the sheet feeding direction) of the manual tray 46A. A left end part of the manual lift plate 46B is vertically movable by an unillustrated drive mechanism. A leading end part (left end part) of a sheet stack placed on the manual tray 46A is moved upward by an upward movement of the manual tray 46B. As a result, a leading end part of the sheet is brought into contact with the feed roller 461.

The width adjusting guides 46C are arranged on the manual lift plate 46B. A pair of width adjusting guides 46C are arranged while being spaced apart in the front-back direction and restrict the positions of the sheets in a width direction. The width adjusting guides 46C are movable in the front-back direction along guide grooves 46B1 formed in the manual lift plate 46B via unillustrated rack and pinion.

The feed roller 461 is arranged above the manual sheet conveyance path 460 to face the manual tray 46A. The feed roller 461 has a circumferential surface 461A to be rotated and conveys the sheet in the sheet feeding direction.

The housing 46H is formed into a box shape extending in the front-back direction. The housing 46H is arranged above the guiding surface 100T (FIG. 3) of the main body unit 100. The housing 46H rotatably supports the feed roller 461 in a central part in the front-back direction. The central part of the housing 46H in the front-back direction is shaped to partly project to right. The housing 46H includes an insertion space 46S (housing portion), in which the feed roller 461 is housed, in this projecting part. Further, a drive gear 462 is arranged in a rear end part of the housing 46H. The drive gear 462 is coupled to the feed roller 461 by an unillustrated shaft. When the drive gear 462 is rotated by an unillustrated drive motor, the feed roller 461 is rotated in a direction of an arrow DR of FIG. 2 via the shaft. Further, the feed roller 461 is detached upward from the insertion space 46S. When the feed roller 461 is detached from the housing 46H, the pad holder 72 to be described later is detachable upward from the mounting portion 100S through the insertion space 46S of the housing 46H.

With reference to FIGS. 3 and 4, the manual sheet feeding unit 46 further includes a separation pad unit 7. The separation pad unit 7 has a function of separating sheets. If the housing 46H is detached from the main body unit 100 in FIG. 2, the separation pad unit 7 is exposed as shown in FIG. 3. The separation pad unit 7 includes a separation pad 71 and the pad holder 72.

The separation pad 71 is arranged to face the circumferential surface 461A of the feed roller 461. The separation pad 71 has a separation surface 71A for forming a nip portion, through which the sheet passes, between the circumferential surface 461A and the separation surface 71A. The separation pad 71 is formed of a plate-like elastic member. As an example, the separation pad 71 is formed of a rubber member. The separation surface 71A of the separation pad 71 has a high friction coefficient with the sheet. The feed of sheets of the sheet stack other than the uppermost one to the downstream side in the sheet feeding direction is prevented by a frictional force between the sheet and the separation surface 71A. In other words, the separation pad 71 feeds the sheets one by one in the sheet feeding direction between the feed roller 461 and the separation pad 71.

The pad holder 72 fixedly supports the separation pad 71. Further, the pad holder 72 is mounted in the mounting portion 100S (FIG. 3) formed in a central part of the main body unit 100 in the front-back direction. The mounting portion 100S has a mounting space 101 into which the pad holder 72 is to be mounted (FIG. 8). The pad holder 72 is mounted into and removed from the mounting portion 100S by a user of the image forming apparatus 1 or a maintenance operator.

With reference to FIGS. 4 and 7, the pad holder 72 includes the first and second holder portions 721, 722. Note that parts of the second holder portion 722 (guiding pieces 723) appear in FIG. 4 in addition to the first holder portion 721. The pad holder 72 slides along body guiding pieces 102 (FIG. 8) when being mounted into the mounting space 101 to be described later and is pressed against the body guiding pieces 102 in the mounting space 101 when the sheet passes through the nip portion. In other words, the posture of the pad holder 72 can be changed between a first posture in which the pad holder 72 is mounted into the mounting space 101 of the mounting portion 100S in a state where predetermined clearances T (FIG. 10) can be formed between the pad holder 72 and the body guiding pieces 102 of the mounting portion 100S and a second posture in which the sheet passes through the nip portion in a state where the pad holder 72 is pressed against the body guiding pieces 102 after being mounted into the mounting space 101 of the mounting portion 100S.

The first holder portion 721 (FIG. 4) supports the separation pad 71. The first holder portion 721 is arranged on a right side of the pad holder 72. The first holder portion 721 is formed of a plate-like member bent along a ridge extending in the front-back direction in a vertical central part. The first holder portion 721 includes a first supporting portion 721A and a second supporting portion 721B. The first supporting portion 721A corresponds to a lower part of the first holder portion 721. The second supporting portion 721B corresponds to an upper part of the first holder portion 721. With reference to FIG. 4, the first supporting portion 721A extends substantially in a vertical direction in the second posture of the pad holder 72 corresponding to a sheet feeding operation. Further, the second supporting portion 721B is arranged at a predetermined angle to the upper end of the first supporting portion 721A and has an inclined surface inclined more toward the downstream side in the sheet feeding direction as it extends upward. As shown in FIG. 4, the second supporting portion 721B fixedly supports the separation pad 71. The first supporting portion 721A (first holder portion 721) includes cylindrical portions 720 (shaft portions), a pair of hole portions 721C and locked portions 721D (FIG. 5).

The cylindrical portions 720 are a pair of cylindrical portions projecting from opposite end parts in a sheet width direction intersecting with the sheet feeding direction on a lower end part of the first supporting portion 721A, in other words, on a part of the first holder portion 721 below the separation pad 71. The cylindrical portions 720 project in the sheet width direction (front-back direction). Each cylindrical portion 720 has an outer circumferential surface 720A (see FIG. 10). The hole portions 721C are open at inner sides of the pair of cylindrical portions 720 in the sheet width direction (front-back direction). The hole portions 721C communicate with cylindrical interiors of the cylindrical portions 720. The hole portions 721C are arranged on the same axis as the cylindrical portions 720. Note that although only the rear hole portion 721C appears in FIG. 5, the hole portion 721C is also similarly arranged on a front side. The locked portions 721D are lower end parts of a pair of ribs arranged on the back side of the first supporting portion 721A and arranged to face a locking portion 727 of the second holder portion 722 to be described later.

The second holder portion 722 (FIGS. 6 and 7) is arranged to face the first holder portion 721 at the left side of the first holder portion 721. The second holder portion 722 is a member extending in the front-back direction and includes a pair of front and rear side walls 722S.

With reference to FIG. 6, the second holder portion 722 includes the guiding pieces 723 (guide plates), contact pieces 724, a cut portion 725 (FIG. 7), projections 726 (projecting portion) and the locking portion 727. The guiding pieces 723 are a pair of plate-like members projecting in the sheet width direction from opposite end parts of the second holder portion 722 in the sheet width direction (front-back direction). The guiding pieces 723 extend in the vertical direction. The contact pieces 724 are a pair of projecting pieces projecting upward from the upper end edge of the second holder portion 722. The cut portion 725 is a recess portion formed by recessing a central part of the lower end edge of the second holder portion 722 upward. The cut portion 725 is recessed into a rectangular parallelepipedic shape to correspond to a projection portion 105 of the mounting portion 100S to be described later. The projections 726 project axially outward (sheet width direction) from the side walls 722S of the second holder portion 722 below the pair of guiding pieces 723. Further, the locking portion 727 is located on a back side of the cut portion 725 and corresponds to a lower end part of the second holder portion 722.

By inserting the projections 726 (FIG. 6) of the second holder portion 722 into the pair of hole portions 721C (FIG. 5) of the first holder portion 721, the first and second holder portions 721, 722 are coupled. At this time, a rotation supporting point CL (a pivot) is formed between the pair of projections 726. In other words, the rotation supporting point CL is an axis extending in the sheet width direction on a lower end side of the second holder portion 722. Then, the first holder portion 721 is rotatably supported relative to the second holder portion 722 about the rotation supporting point CL. Note that the rotation supporting point CL is arranged on the same axis of a cylinder axis of the pair of cylindrical portions 720 (FIG. 5).

Further, the separation pad 7 includes a biasing spring 73 (FIG. 7). The biasing spring 73 is a coil spring compressed and arranged between the first and second holder portions 721, 722. The biasing spring 73 biases the first holder portion 721 toward an upper-right side. As a result, the separation pad 71 (FIG. 3) is pressed toward the circumferential surface 461A (FIG. 2) of the feed roller 461, whereby the nip portion is stably formed. Note that a nip pressure is suitably maintained also in the pad holder 72 removably mountable into the mounting portion 100S by arranging the biasing spring 73 between the first and second holder portions 721, 722. In other words, if a biasing spring is fixedly arranged in the mounting portion 100S, a contact position of the removable pad holder 72 and the biasing spring is not stabilized and the nip pressure tends to vary. Note that an opening angle between the first and second holder portions 721, 722 is restricted to a predetermined range by the contact of the locking portion 727 (FIG. 6) of the second holder portion 722 with the locked portions 721D (FIG. 5) of the first holder portion 721. In other words, the locked portions 721D of the first holder portion 721 and the locking portion 727 of the second holder portion 722 function as a rotation stop member for the first holder portion 721.

With reference to FIG. 8, the mounting portion 100S includes the aforementioned mounting space 101, the body guiding pieces 102, guide grooves 103, contact supporting portions 104 and the projection portion 105.

The mounting space 101 is a space into which the pad holder 72 is to be mounted. The body guiding pieces 102 are arranged in the mounting portion 100S to guide the pad holder 72 into the mounting space 101 of the mounting portion 100S. Specifically, the body guiding pieces 102 are arranged in opposite end parts of the mounting space 101 in the sheet width direction at an upstream side of the mounting space 101 in the sheet feeding direction. The body guiding pieces 102 are a pair of projection members extending in the vertical direction while having a predetermined width in the front-back direction. Each body guiding piece 102 has a guide surface 102A (see FIG. 10) extending in the vertical direction while facing the pad holder 72 at the upstream side of the mounting portion 100S in the sheet feeding direction. A pair of the guide surfaces 102A are arranged on opposite end parts of the mounting portion 100S in the sheet width direction.

The guide grooves 103 are pair of groove portions formed by partly cutting the main body unit 100 including the guiding surface 100T at opposite end parts of the mounting portion 100S in the front-back direction. The guide grooves 103 extend in the vertical direction. The guiding pieces 723 of the pad holder 72 are inserted into the guide grooves 103. The contact supporting portions 104 are a pair of projecting pieces projecting from wall portions 104T on a downstream side (left side) of the mounting portion 100S in the sheet feeding direction. Note that the wall portions 104T are wall surfaces of the apparatus main body 100 defining a side surface on a left side (downstream side in the sheet feeding direction) of the mounting space 101. The contact supporting portions 104 project toward the upstream side in the sheet feeding direction. Further, upstream side surfaces of the contact supporting portions 104 in the sheet feeding direction are inclined surfaces facing a right-lower side. The aforementioned contact pieces 724 of the pad holder 72 are engaged with the contact supporting portions 104. The projection portion 105 is a projection portion projecting upward in a bottom part of the mounting space 101 of the mounting portion 100S. The projection portion 105 has a substantially rectangular parallelepipedic shape. The projection portion 105 is inserted into the cut portion 725 of the pad holder 72. The position of the pad holder 72 in the front-back direction (sheet width direction) is restricted by the projection portion 105 and the cut portion 725.

Figure 9:
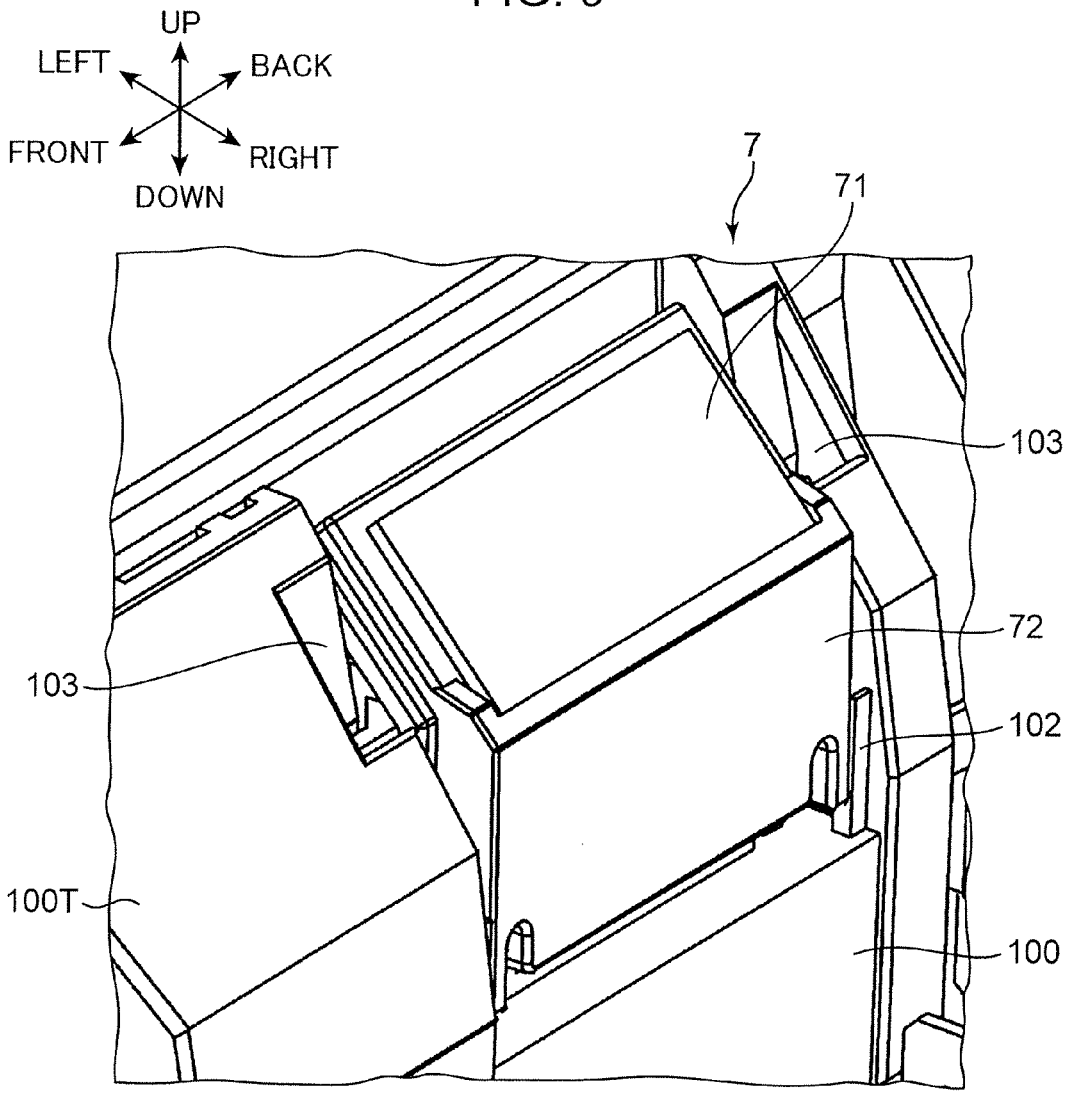
FIG. 9 is a perspective view showing a state where the holder is mounted in the mounting portion according to the embodiment of the present disclosure.
Figure 10:
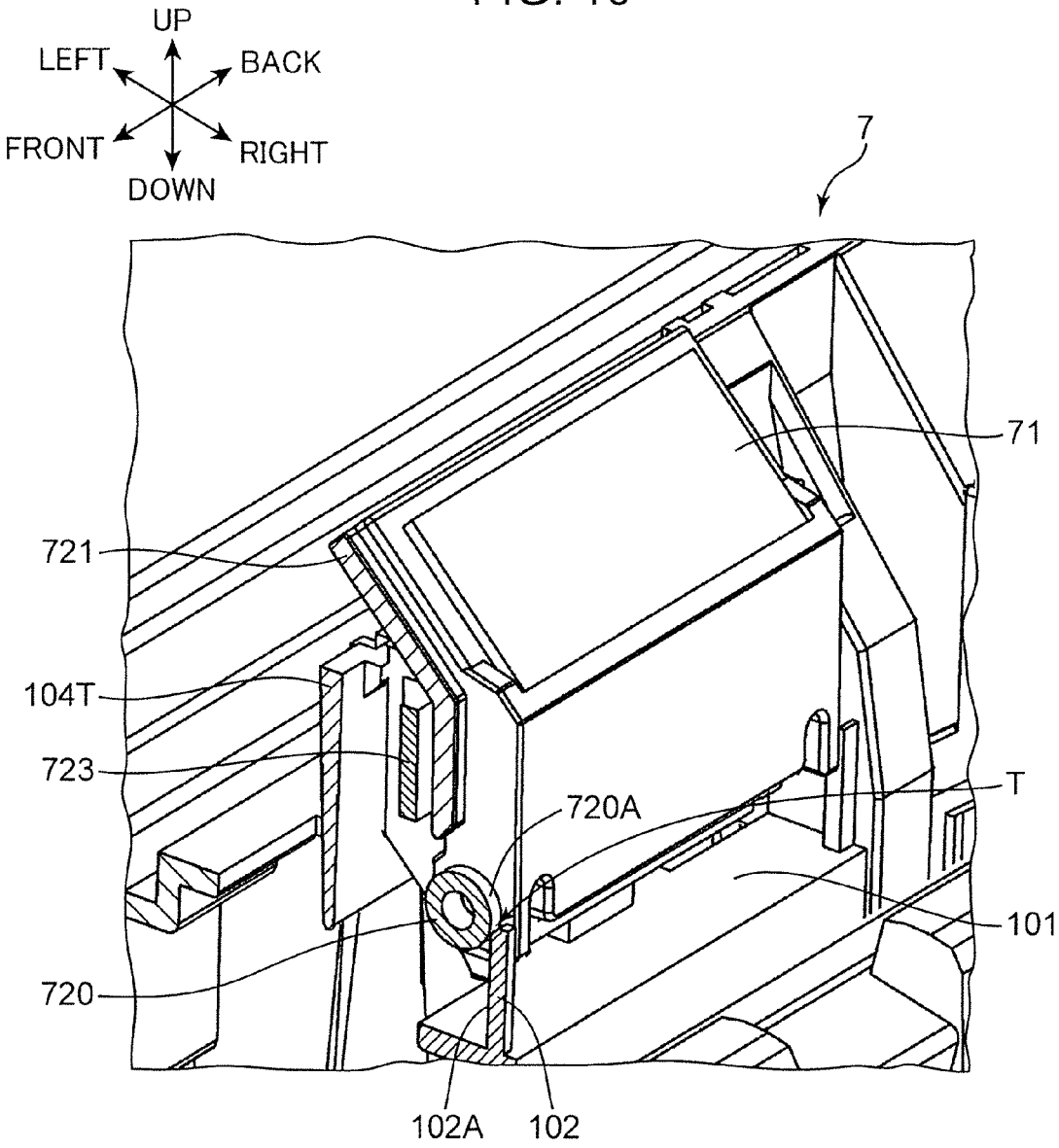
FIG. 10 is a sectional perspective view when the holder is mounted into the mounting portion according to the embodiment of the present disclosure.
Figure 11:
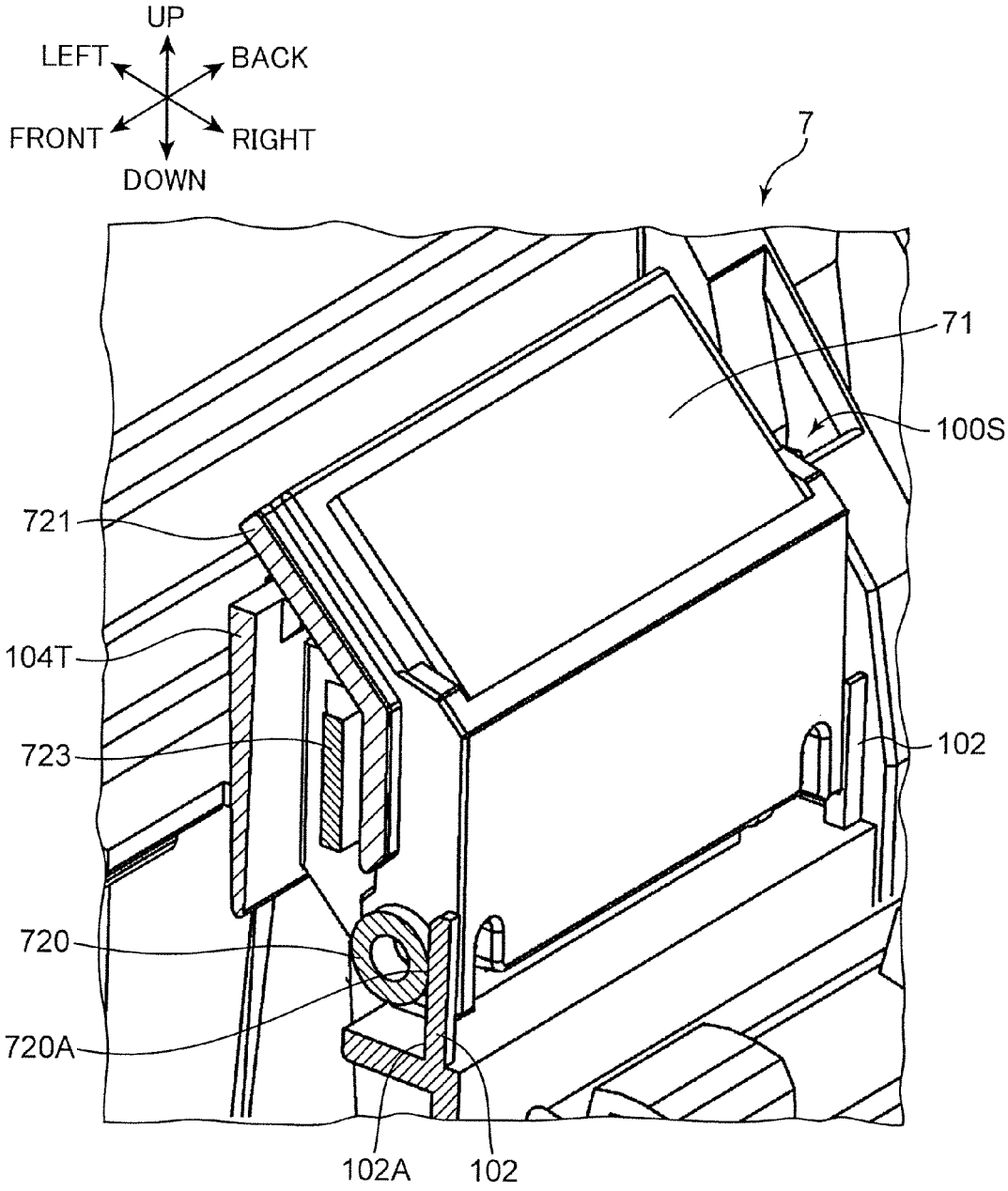
FIG. 11 is a sectional perspective view showing the state where the holder is mounted in the mounting portion according to the embodiment of the present disclosure.

FIG. 9 is a perspective view of the separation pad unit 7 in a state where the pad holder 72 is mounted in the mounting space 101 of the mounting portion 100S. FIG. 10 is a sectional perspective view of the separation pad unit 7 when the pad holder 72 is mounted into the mounting space 101 of the mounting portion 100S. FIG. 11 is a sectional perspective view of the separation pad unit 7 during a sheet feeding operation in the state where the pad holder 72 is mounted in the mounting space 101 of the mounting portion 100S.

With reference to FIG. 2, when the feed roller 461 is detached from the insertion space 46S of the housing 46H, the separation pad unit 7 is exposed to the interior of the insertion space 46S. The pad holder 72 is vertically mounted into and removed from the mounting portion 100S through the insertion space 46S. Note that, as just described, the feed roller 461 and the pad holder 72 are mounted and removed in the same directions utilizing the insertion space 46S of the housing 46H in this embodiment. Thus, operability associated with the mounting and removal of the feed roller 461 and the pad holder 72 is improved.

With reference to FIG. 10, the pad holder 72 is mounted into and removed from the mounting portion 100S in a state where the first and second holder portions 721, 722 are most spaced apart from each other about the rotation supporting point CL by a biasing force of the biasing spring 73. The posture of the pad holder 72 at this time is defined to be the first posture when the pad holder 72 is mounted into the mounting space 101. Note that although the first holder portion 721 is shown to extend along the second holder portion 722 in FIG. 10, the first holder portion 721 is rotated to right about the rotation supporting point CL from the posture shown in FIG. 10 in the first posture and the first supporting portion 721A (FIG. 4) is inclined toward the upstream side (right side) in the sheet feeding direction as it extends upward.

When the pad holder 72 is mounted into the mounting portion 100S from above, the guiding pieces 723 (FIGS. 4 and 10) projecting from the second holder portion 722 are inserted into the guide grooves 103 (FIGS. 8 and 9). Further, the pad holder 72 is guided by the guide surfaces 102A of the body guiding pieces 102 while sliding along the guide surfaces 102A (FIG. 10). Specifically, as shown in FIG. 10, the outer circumferential surfaces 720A of the cylindrical portions 720 of the first holder portion 721 slide while being vertically guided by the guide surfaces 102A in a state where the predetermined clearances T can be formed between the outer circumferential surfaces 720A and the guide surfaces 102A. Thus, the outer circumferential surfaces 720A and the guide surfaces 102A do not strongly rub against each other when the pad holder 72 is mounted into the mounting portion 100S. Therefore, the pad holder 72 is smoothly mounted into the mounting portion 100S. Particularly, since the outer circumferential surfaces 720A of the cylindrical portions 720 are guided by the guide surfaces 102A of the body guiding pieces 102, contact areas of the cylindrical portions 720A and the guide surfaces 102A are reduced by the cylindrical shape of the outer circumferential surfaces 720A and strong rubbing of the outer circumferential surfaces 720A and the guide surfaces 102A is further suppressed. Note that the first and second holder portions 721, 722 are most spaced apart from each other about the rotation supporting point CL as described above when the pad holder 72 is mounted. Even in such a case, since the cylindrical portions 720 have a cylindrical shape, any area of the outer circumferential surface 720A of the cylindrical portion can constantly face the guide surface 102A of the corresponding body guiding piece 102 even if an angle between the first and second holder portions 721, 722 changes. As a result, the pad holder 72 is stably guided into and out of the mounting space 101 by the body guiding pieces 102.

After the pad holder 72 is mounted into the mounting space 101 of the mounting portion 100S, the feed roller 461 is mounted into the insertion space 46S of the housing 46H. At this time, the feed roller 461 presses the separation pad 71 downward against the biasing force of the biasing spring 73, whereby an upper end side of the first holder portion 721 rotates toward the downstream side in the sheet feeding direction about the rotation supporting point CL to approach the second holder portion 722. Associated with this movement, the lower end part of the first holder portion 721 including the cylindrical portions 720 moves to the upstream side in the sheet feeding direction, whereby the outer circumferential surfaces 720A of the cylindrical portions 720 are pressed against the guide surfaces 102A of the body guiding pieces 102 (FIG. 11). The posture of the pad holder 72 at this time is defined to be the second posture. Note that, in the second posture, the contact pieces 724 of the second holder portion 722 are arranged to face the contact supporting portions 104 of the mounting portion 100S and the second holder portion 722 is fixed by the contact of each guiding piece 723 of the second holder portion 722 with one surface of the corresponding guide groove 103 of the mounting portion 100S. Then, the biasing spring 73 biases the separation pad 71 toward the feed roller 461 via the first holder portion 721. Thus, the nip portion is stably formed.

The above is described differently. After the pad holder 72 is mounted into the mounting portion 100S, the cylindrical portions 720 arranged below the separation pad 71 are pressed rightward toward the guide surfaces 102A of the body guiding pieces 102 utilizing a reaction force of a force of the feed roller 461 pressing the separation pad 71 supported on the pad holder 72 toward a lower-left side.

As just described, in this embodiment, the pad holder 72 is pressed against the guide surfaces 102A of the body guiding pieces 102 when the separation pad 71 forms the nip portion after the pad holder 72 is mounted into the mounting portion 100S. Thus, vibration generated when a sheet passes through the nip portion during a sheet feeding operation is reduced by the contact of the pad holder 72 and the body guiding pieces 102. As a result, the generation of abnormal noise when the sheet passes through the nip portion is suppressed. Particularly, in this embodiment, the outer circumferential surfaces 720A of the cylindrical portions 720 come into contact with the guide surfaces 102A of the body guiding pieces 102. Thus, the outer circumferential surfaces 720A come into point contact with the guide surfaces 102A in a cross-section intersecting with the cylinder axis of the cylindrical portions 720. As a result, the outer circumferential surfaces 720A can reliably come into contact with the guide surfaces 102A. Further, the separation pad 71 is stably held in position by the contact of the pad holder 72 with the body guiding pieces 102. As a result, the position of the nip portion between the separation pad 71 and the feed roller 461 is less likely to vary and the manual sheet conveyance path 460 is stably maintained.

Further, in this embodiment, the cylindrical portions 720 are arranged on the first holder portion 721 of the pad holder 72 and the guiding pieces 723 are arranged on the second holder portion 722. Accordingly, even if the pad holder 72 is formed by combining two plate-like members, the mounting and removal of the pad holder 72 are more stably realized since guide members (cylindrical portions 720, guiding pieces 723) are arranged on the both first and second holder portions 721, 722.

Although the manual sheet feeding unit 46 (manual tray 46A) and the image forming apparatus 1 provided with the same according to the embodiment of the present disclosure are described above, the present disclosure is not limited to this. For example, the following modification may be adopted.

Although the manual tray 46A is described as a sheet tray and the manual sheet feeding unit 46 is described as a sheet feeder in the above embodiment, the present disclosure is not limited to this. The present disclosure may be applied to the automatic document feeder 20 (sheet feeder) of the image forming apparatus 1 as a sheet feeder for feeding a sheet as a document. In this case, the image reading apparatus 2 is configured by the aforementioned reading unit 25 (reading mechanism) and the automatic document feeder 20. The reading unit 25 is arranged to face a sheet conveyance path extending from the document tray 21 (sheet stacking portion). A feed roller similar to that of the above embodiment, the separation pad 71 and the pad holder 72 are arranged in the document feeding unit 22 of the automatic document feeder 20. Even in this case, the pad holder 72 supporting the separation pad 71 is smoothly mounted. Further, vibration generated when a document passes through a nip portion during a document feeding operation from the document tray 21 is suppressed by the contact of the pad holder 72 and the body guiding pieces 102. As a result, abnormal noise generated when the document passes through the nip portion is reduced.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet feeder, comprising:

a casing;

a sheet stacking portion arranged in the casing and on which sheets are to be placed;

a sheet conveyance path arranged in the casing and in which the sheets stacked on the sheet stacking portion are fed in a predetermined sheet feeding direction;

a feed roller mounted in the casing to face a downstream side of the sheet stacking portion in the sheet feeding direction from above and feeds the sheet toward the sheet conveyance path;

a separation pad arranged to face the feed roller so that a nip portion is defined between the feed roller and the separation pad, the sheets being fed one by one through the nip portion in the sheet feeding direction;

a holder mountable into and removable from the casing and fixedly supporting the separation pad, the holder including a first supporting plate that supports the separation pad, a second supporting plate facing the first supporting plate and a biasing spring compressed between the first and second supporting plates, the first supporting plate includes:

a first supporting portion extending vertically, and a second supporting portion inclined toward a downstream side in the sheet feeding direction as the second supporting portion extends up from an upper end of the first supporting portion, the second supporting portion defining a part of the first supporting plate that holds the separation pad, a pair of shaft portions projecting respectively in a sheet width direction from opposite sides of a lower end part of the first supporting portion of the holder in the sheet width direction, each shaft portion having an outer circumferential surface, a pair of holes arranged on the same axis as the shaft portions, the second supporting plate includes a pair of projecting portions respectively projecting in the sheet width direction from opposite sides of a lower end side of the second supporting plate in the sheet width direction, the first supporting plate being supported rotatably on the second supporting plate with the projecting portions as pivots by inserting the projecting portions into the holes;

a mounting portion arranged in the casing, and the holder being mounted into the mounting portion, the mounting portion including a wall portion standing at a side downstream of the holder in the sheet feeding direction and defining a side surface at a downstream side in the sheet feeding direction, the second supporting plate facing the wall portion of the mounting portion and the biasing spring biasing the separation pad toward the feed roller when the sheet passes through the nip portion; and a guiding member arranged in the mounting portion and guiding the holder, the guiding member having a pair of guide surfaces arranged at an upstream side of the mounting portion in the sheet feeding direction and extending in a vertical direction while facing the holder, the guide surfaces being arranged on opposite sides of the mounting portion in the sheet width direction intersecting the sheet feeding direction;

wherein, a posture of the holder is changeable between a first posture in which predetermined clearances are formable between the guide surfaces of the guiding member and the outer circumferential surfaces of the shaft portions when the holder is mounted into the mounting portion and a second posture in which the outer circumferential surfaces of the shaft portions are pressed directly against the guide surfaces of the guiding member when the sheet passes through the nip portion after the holder is mounted into the mounting portion, the biasing spring biases the separation pad toward the feed roller when the sheet passes through the nip portion; and the outer circumferential surfaces of the shaft portions are guided by the guide surfaces when the holder is mounted.

2. A sheet feeder according to claim 1, wherein:

the holder is mounted into and removed from the mounting portion in a state where the first and second supporting plates are most spaced apart from each other about the pivots by a biasing force of the biasing spring; and a lower end side of the first supporting plate including the shaft portions moves toward the upstream side in the sheet feeding direction and the outer circumferential surfaces of the shaft portions are pressed against the guide surfaces of the guiding member as the feed roller presses the separation pad against the biasing force of the biasing spring when the feed roller is mounted after the holder is mounted into the mounting portion and an upper end side of the first supporting plate moves toward the downstream side in the sheet feeding direction to approach the second supporting plate when the sheet passes through the nip portion.

3. A sheet feeder according to claim 2, wherein:

the casing includes a roller housing having a housing portion above the mounting portion, the roller housing houses the feed roller and supports the feed roller;

the feed roller is detachable upward from the housing portion of the roller housing; and the holder is detached upward from the mounting portion through the housing portion from which the feed roller is detached.

4. A sheet feeder according to claim 1, wherein:

the holder further includes a guide plate projecting in the sheet width direction from the second supporting plate; and the mounting portion further includes a guiding groove which extends in the vertical direction and into which the guide plate is inserted.

5. A sheet feeder according to claim 1, wherein:

the holder includes a recess portion;

the mounting portion includes a projection portion facing and projecting toward the recess portion; and the projection portion is inserted into the recess portion to restrict the position of the holder in the sheet width direction intersecting with the sheet feeding direction when the holder is mounted into the mounting portion.

6. An image forming apparatus, comprising:

a sheet feeder according to claim 1; and an image forming unit arranged in the casing and configured to form an image on a sheet.

7. An image forming apparatus, according to claim 6, wherein:

the sheet stacking portion is a manual tray mounted in the casing.

8. An image reading apparatus, comprising:

a sheet feeder according to claim 1; and a reading mechanism for reading a document image of a sheet.

9. A sheet feeder, comprising:

a casing;

a sheet stacking portion arranged in the casing and on which sheets are to be placed;

a sheet conveyance path arranged in the casing and in which the sheets stacked on the sheet stacking portion are fed in a predetermined sheet feeding direction;

a feed roller mounted in the casing to face a downstream side of the sheet stacking portion in the sheet feeding direction from above and feeds the sheet toward the sheet conveyance path;

a separation pad arranged to face the feed roller so that a nip portion is defined between the feed roller and the separation pad, the sheets being fed one by one through the nip portion in the sheet feeding direction;

a holder mountable into and removable from the casing and fixedly supporting the separation pad, the holder including a first supporting plate for supporting the separation pad, a second supporting plate arranged to face the first supporting plate, and a biasing spring compressed and arranged between the first and second supporting plates, the first supporting plate including:

a first supporting portion extending vertically, a second supporting portion inclined toward a downstream side in the sheet feeding direction as the second supporting portion extends up from an upper end of the first supporting portion and configured to hold the separation pad, and a pair of shaft portions disposed respectively at opposite sides of a lower end part of the first supporting portion in a sheet width direction intersecting the sheet feeding direction and projecting respectively in the sheet width direction, each of the shaft portions having an outer circumferential surface;

a pair of holes arranged on a common axis with the shaft portions;

the second supporting plate including a pair of projecting portions respectively projecting in the sheet width direction from opposite sides of a lower end side of the second supporting plate in the sheet width direction, the first supporting plate is supported rotatably on the second supporting plate with the projecting portions as a pivot by inserting the pair of projecting portions into the pair of hole portions;

a mounting portion arranged in the casing and having the holder mounted therein, the mounting portion including a guiding member that guides the holder, the guiding member including a pair of guide surfaces arranged at an upstream side of the mounting portion in the sheet feeding direction and extending in a vertical direction while facing the holder, a wall portion standing at a side downstream of the holder in the sheet feeding direction and defining a side surface at a downstream side in the sheet feeding direction, wherein:

the outer circumferential surfaces of the shaft portions are guided by the guide surfaces of the guiding member when the holder is mounted while being pressed against the guide surfaces when the sheet passes through the nip portion;

a posture of the holder is changeable between a first posture in which predetermined clearances are formable between the guide surfaces of the guiding member and the outer circumferential surfaces of the shaft portions when the holder is mounted into the mounting portion and a second posture in which the outer circumferential surfaces of the shaft portions are pressed directly against the guide surfaces of the guiding member when the sheet passes through the nip portion after the holder is mounted into the mounting portion; and the second supporting plate is arranged to face the wall portion of the mounting portion and the biasing spring biases the separation pad toward the feed roller when the sheet passes through the nip portion.

10. A sheet feeder according to claim 9, wherein:

the holder is mounted into and removed from the mounting portion in a state where the first and second supporting plates are most spaced apart from each other about the pivot by a biasing force of the biasing spring; and a lower end side of the first supporting plate including the shaft portions moves toward the upstream side in the sheet feeding direction and the outer circumferential surfaces of the shaft portions are pressed against the guide surfaces of the guiding member as the feed roller presses the separation pad against the biasing force of the biasing spring when the feed roller is mounted after the holder is mounted into the mounting portion and an upper end side of the first supporting plate moves toward the downstream side in the sheet feeding direction to approach the second supporting plate when the sheet passes through the nip portion.

11. A sheet feeder according to claim 10, wherein:

the casing includes a roller housing having a housing portion above the mounting portion, the roller housing houses the feed roller and supports the feed roller;

the feed roller is detachable upward from the housing portion of the roller housing; and the holder is detached upward from the mounting portion through the housing portion from which the feed roller is detached.

12. A sheet feeder according to claim 9, wherein:

the holder further includes a guide plate projecting in the sheet width direction from the second supporting plate; and the mounting portion further includes a guiding groove which extends in the vertical direction and into which the guide plate is inserted.

13. A sheet feeder according to claim 9, wherein:

the holder includes a recess portion;

the mounting portion includes a projection portion facing and projecting toward the recess portion; and the projection portion is inserted into the recess portion to restrict the position of the holder in the sheet width direction intersecting with the sheet feeding direction when the holder is mounted into the mounting portion.

14. An image forming apparatus, comprising:

a sheet feeder according to claim 9; and an image forming unit arranged in the casing and configured to form an image on a sheet.

15. An image reading apparatus, comprising:

a sheet feeder according to claim 9; and a reading mechanism for reading a docent image of a sheet.

* * * * *